United States Patent [19]

Hsi-Shan

[11] Patent Number: 4,494,275

[45] Date of Patent: Jan. 22, 1985

[54] SWINGING DOOR HINGE ASSEMBLY HAVING A ROLLING MEMBER

[75] Inventor: Chen Hsi-Shan, Taipei, Taiwan

[73] Assignee: Sun Longitude Corporation, Taipei, Taiwan

[21] Appl. No.: 401,217

[22] Filed: Jul. 23, 1982

[51] Int. Cl.[3] ..... E05F 1/04

[52] U.S. Cl. ..... 16/314; 16/276

[58] Field of Search ..... 16/311, 312, 313, 314, 16/275, 309, 276, 235, 236, 242, 386; 49/236, 237, 238, 239, 240

[56] References Cited

U.S. PATENT DOCUMENTS

| | | | |
|---|---|---|---|
| 453,803 | 6/1891 | Faulhaber et al. | 16/314 |
| 1,312,667 | 8/1919 | Ayres | 16/315 |
| 1,865,339 | 6/1932 | Schilling | 16/235 |
| 2,735,144 | 2/1956 | Anderson et al. | 49/237 |
| 2,747,238 | 5/1956 | Jones et al. | 16/313 X |
| 4,259,763 | 4/1981 | Hsu | 16/386 X |
| 4,391,020 | 7/1983 | Hsu | 16/316 X |

*Primary Examiner*—Fred A. Silverberg
*Attorney, Agent, or Firm*—Balogh, Osann, Kramer, Dvorak, Genova & Traub

[57] ABSTRACT

A swinging door hinge assembly comprises a primary hinge and a secondary hinge. By way of an axle rotating on a staircase-shaped axle seat in the primary hinge, the door can be opened in either direction, slowly closed, or opened at a wide angle for a long time. The secondary hinge includes an inner and an outer eccentric axle bushing by which the secondary hinge can automatically adjust its axis to be in alignment with that of the primary hinge, i.e., in a co-axial alignment in case of the door hinge assembly generating any eccentric condition. Otherwise, the door cannot be operated smoothly in case the two hinges are not co-axially aligned. The door hinge assembly may be easily assembled or disassembled, between the left and right side primary hinge pieces, and also between the left and right side secondary hinge pieces.

6 Claims, 19 Drawing Figures

132
131
137
133
13
132
138

90° 80°
125°
45°
135°
35°
180°
0°
135°
35°
125°
45°
90° 80°

90°
80°
45°
35°
180°
0°
35°
45°
90°
80°

136
132
132
13
138

142
141
14
143
137
132
131
133
134
132
135
138
1
121
11
12
15
16
17
18
26
25
24
2
221
22
21
235
237
236
23
233
234
233'
234'
231
232
235'

231
238

53
54
55
63
a
a
531
632

632
63
55
54
a
53
531 a
a 531
53
532
a
54
a
55
5
521
522
52
51
56
57
66
6
621
61
62
634
63
631
632
633
64
65

SWINGING DOOR HINGE ASSEMBLY HAVING A ROLLING MEMBER

BACKGROUND OF THE INVENTION

So far, there is no automatic door hinge able to have a door being opened at a large angle without being moved by the normal flowing air, and no door hinge being furnished with a buffer means; therefore, the door using conventional hinge is liable to be damaged. In the general conventional hinges, once they are installed on the jamb and door, it would be rather difficult to disassemble. Further, the existing general secondary hinges have no satisfactory structure in correcting the deviated axis between the primary and the secondary hinges; as a result, after a long period of use, the door will not be opened or shut smoothly. This invention is particularly designed to improve or eliminate the aforesaid drawbacks of the conventional hinges.

SUMMARY OF THE INVENTION

This invention provides a new "Automatic Door-shutting Device," which comprises a set of primary hinge and a set of secondary hinge. Said primary hinge not only can rotate towards both directions, but also has a buffer and retarding effects during shutting the door, and also can have the door opening at a large angle for longer time without being moved by a normal flowing air. Said secondary hinge is furnished with two eccentric axle bush, which may be used for correcting and maintaining the door on the real axial line in case of said automatic door-shutting device having as deviation from the right center, i.e., the primary hinge and the secondary hinge being aligned on the same asis so as to have the door rotating smoothly.

Further, the left and right side primary hinge pieces, and the left and right side secondary hinge pieces all are detachable easily. In other words, this invention is easy to be installed and removed from a door so as to facilitate the maintenance of the door.

BRIEF DESCRIPTION OF THE DRAWINGS

FIG. 1—1 shows another embodiment of the staircase-shaped axle seat of said primary hinge in this invention.

FIG. 1-2 shows the various angles of the staircase-shaped groove in another embodiment of the stair-case-shaped axle seat of this invention.

FIG. 1-3 shows the various angles of the stair-case-shaped groove of the stair-case-shaped axle seat in this invention.

FIG. 1-4 shows a front view of another embodiment of the staircase-shaped axle seat of the primary hinge in this invention.

FIG. 1-5 shows an embodiment of a roller under a lug at the bottom of the axle of said primary hinge.

FIG. 2 shows an assembled view of said primary hinge in closed manner.

FIG. 3 shows a perspective and exploded view of the left and right side primary hinge pieces of said primary hinge.

FIG. 4 shows a sectional view of said primary hinge in opening manner.

FIG. 4-1 shows a half sectional view of part of said primary hinge.

FIG. 5 shows a perspective and exploded view of the secondary hinge in this invention.

FIG. 5-1, 5-2, 5-3 show the theory of said secondary hinge how to correct the common axis between said two hinges in this invention.

FIG. 8-1 shows a half sectional view of part of said secondary hinge.

DETAILED DESCRIPTION

Figures 1, 2, 3, 4, 5:
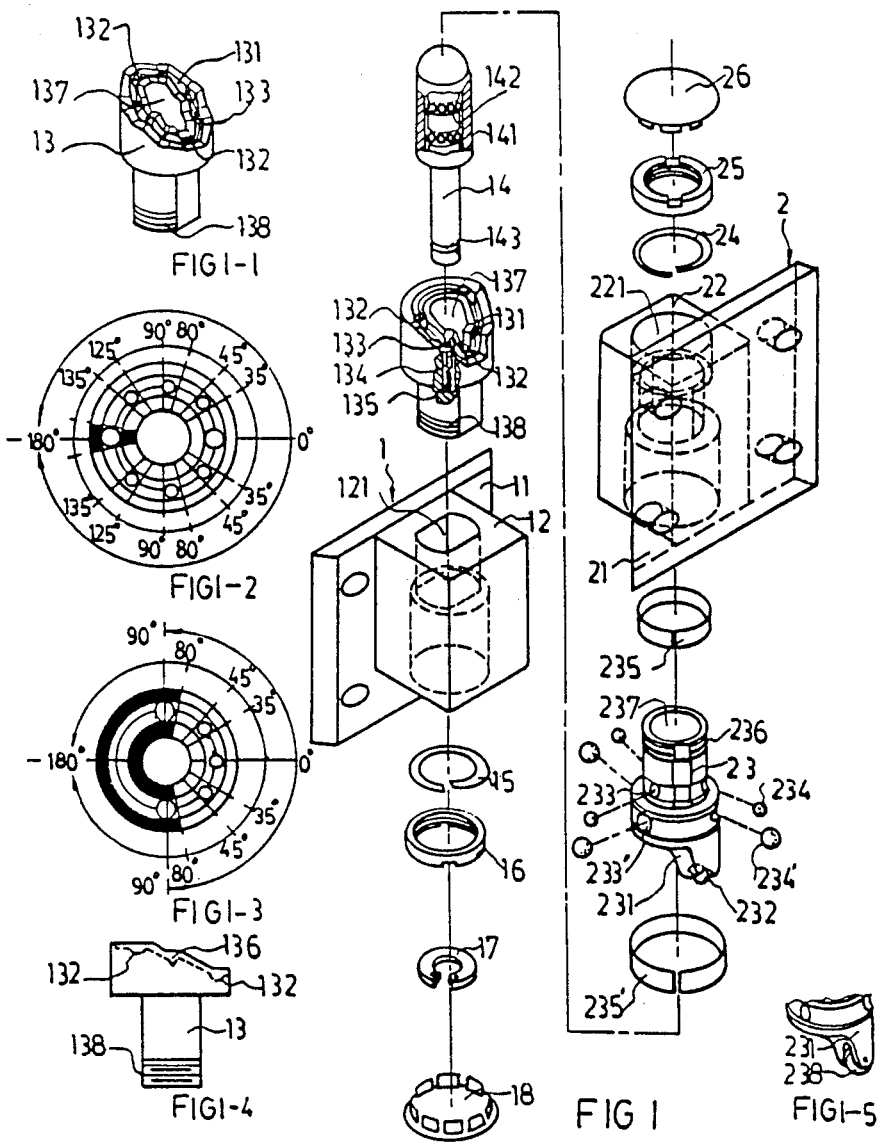
Figure 2:
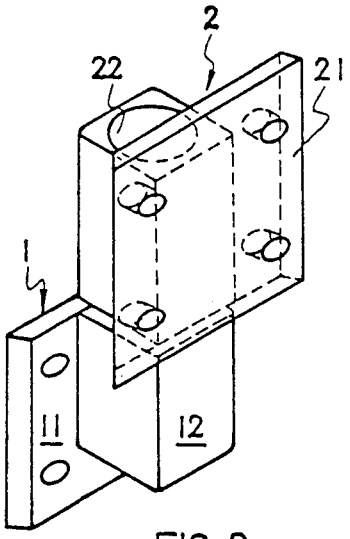
Figure 3:
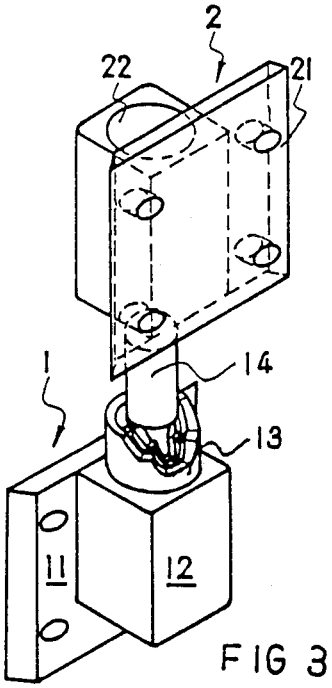
Figure 4:
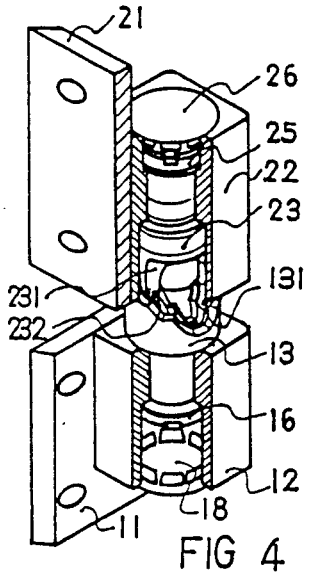
Figures 1, 4:
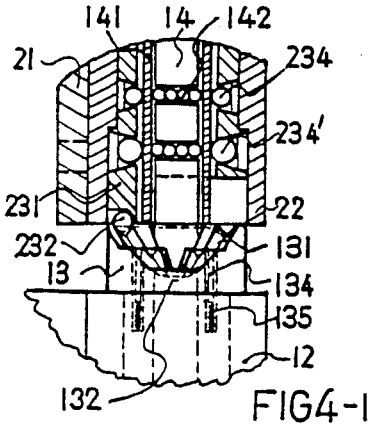
Figures 1, 2, 3, 5:
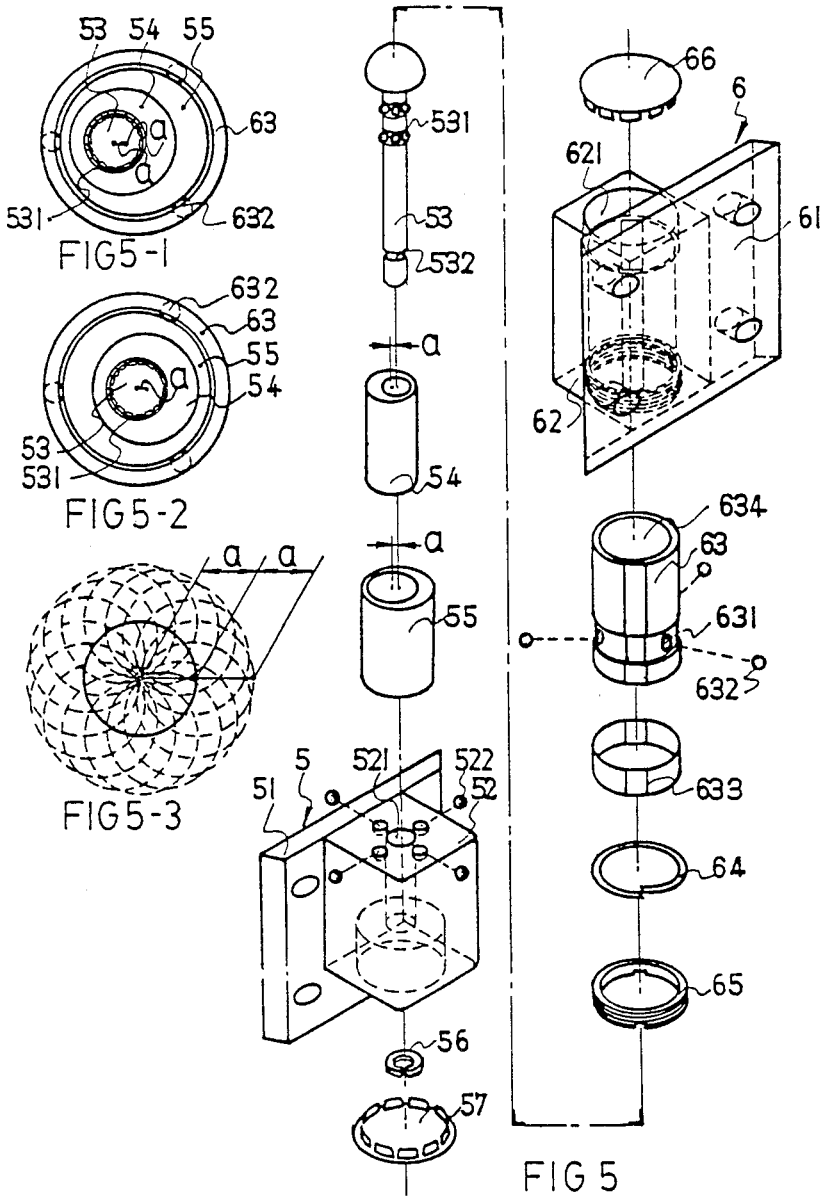
Figure 9:
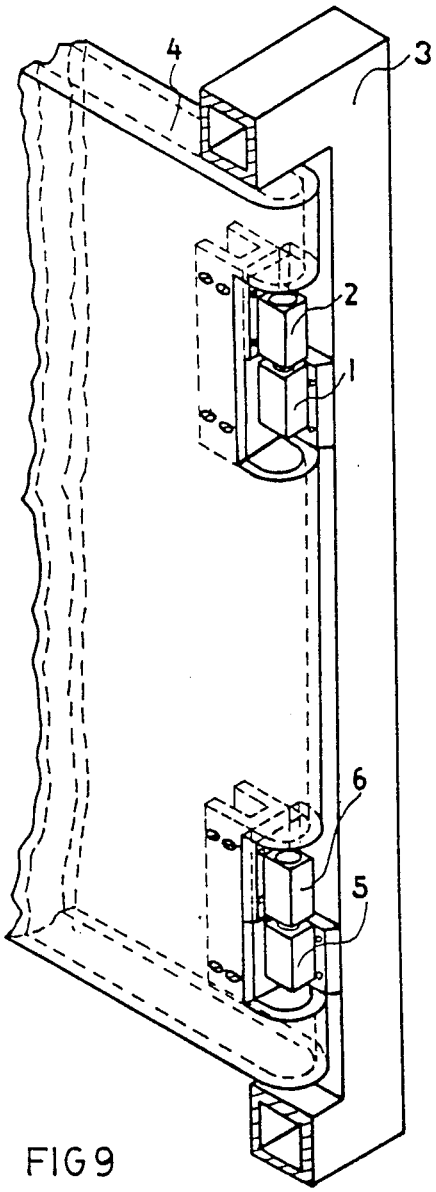
FIG. 9 shows said primary and secondary hinges being installed on the jamb and door respectively.

This invention comprises one set of primary hinges and one set of secondary hinges, of which the structure and the functions are described in detail by referring to the drawings attached as follows:

A. The structure and functions of the primary hinge:

FIG. 1 shows an exploded view of the primary hinge in this invention, which includes a left side primary hinge piece (1) fixed on the upper portion of the jamb (3) and a right side primary hinge piece (2) fixed on the upper portion of the door (4) (as shown in FIG. 9). Said left side primary hinge (1) may be attached to the jamb (3) by means of a positioning piece (11), which has a base sleeve (12) with a stair-case-shaped hole (121) so as to facilitate the staircase-shaped axle seat (13) and the lower portion of the axle rod (14) to be fitted in and fixed thereto. At the top portion of the axle rod (14), an axle bush (141) is mounted; between said axle bush (141) and said axle rod (14), a steel ball collar (142) is furnished so as to enable said axle bush (141) smoothly moving around said axle rod (14). The top of said staircase-shaped axle seat (13) is partially in slantingly flat shape with a staircase-shaped groove (131), for which FIG. 1-3 may be referred to for better understanding. In said staircase-shaped groove (131), the 0° point is the lowest point, from where the slope surface is gradually and slantingly going up in both the clockwise and the counter-clockwise directions at an angle about 35°; then, the ascending slope is reduced. At approximate 45°, the slope begins to raise again until to an angle of 80°. After the angle of 80°, the surface become horizontal. At 0° and 90° position, a ball socket (132) is furnished; in the portion of small angle slope (35°–45°), a small hole (133) is furnished to install a retarding pin (134) and a spring (135) therein. The top end of said retarding pin (134) has a very small part being projected in the stair-case-shaped groove (131).

FIG. 1-4 shows a V-shaped groove (136) being furnished in said small slope portion (35°–45°) to replace said retarding pin (134).

FIG. 1—1 and 1-2 show another embodiment of the stair-case-shaped axle seat (13), of which the slope surface begins to gradually go up from the lowest point 0° at both sides; after a slope angle about 35°, the slope has smaller angle; at the positions around 35°–45°, 80°–90°, and 125°–135°, three small holes (133) are furnished so as to install a retarding pin (134) and a spring (135) therein respectively; at 0° and 180° positions; a ball socket (132) is furnished therein respectively.

Before assembling the lower portion of said staircase-shaped axle seat (13) and the axle rod (14) into the stair-case-shaped hole (121) of the base sleeve (12), first put the lower portion of said axle rod (14) into the center hole (137) of said staircase-shaped axle seat (13); then, put the lower portion of said staircase-shaped axle seat (13) into the staircase-shaped hole (121). Since the inner surface of said hole (121) and the lower portion of said axle seat (13) both have a flat surface, said stair-case-shaped axle seat (13) would not rotate within said hole (121). At the thread portion (138) of the lower portion of said stair-case-shaped axle seat (13), a spring washer (15), a nut (16) are attached respectively so as to fix said staircase-shaped axle seat (13) in said base sleeve (12). Upon the axle rod (14) being put into the center hole (137) of said stair-case-shaped axle seat (13), the axle bush (141) will rest on the top surface of said stair-case-axle seat (13); then, the lower end of said axle rod (14) will extend out of the bottom of said stair-case-shaped axle seat (13), being fitted with a lock ring (17) in the groove (143) so as to prevent said axle rod (14) from loosing; then, the bottom of the stair-case-shaped hole (121) is covered with a lid (18) for better looking and dust-proof purposes. FIG. 3 shows the outer view of an assembled left side primary hinge piece (1).

FIG. 1 shows a right side primary hinge piece (2) to be attached to a positioning piece (21) that is put on a door. At one side of said positioning piece (21), a base sleeve (22) is furnished.

The top portion of the axle (23) is to be fitted and locked into the stair-case-shaped hole (221) of said base sleeve (22).

On the tip of a lug (231) extending from the bottom of said axle (23), a steel ball (232) or a roller (231) is furnished as shown in FIG. 1–5. Around the main body of said axle (23), a small hole (233, 233') filled with a steel ball (234, 234') is furnished at an angle of every 120°; then, a steel ball collar (235, 235') is fitted outside the steel balls; finally, the axle (23) is fitted into the stair-case-shaped hole (221) of said base sleeve (22). After said axle (23) being put into said stair-case-shaped hole (221), it will be unable to rotate because of the top portion of said axle and inside said stair-case-shaped hole (221) both having a flat surface; then, put the spring washer (24), the nut (25) over the top thread portion (236) of said axle (23) in due order so as to fix the axle (23) on said base sleeve (22). Finally, a lid (26) is put over the stair-case-shaped hole(221) for dustproof and better looking purposes. FIG. 3 shows the outer view of an assembled right side primary hinge piece (2).

As shown in FIG. 1, FIG. 4 and 4–1, after said left side and right side primary hinge pieces (1) (2) being assembled together, only the upper portion of said axle rod (14) is inserted into the axle hole (237) of said axle (23). Since the steel balls (234, 234') of said axle (23) are set around the outer surface of the axle bush (141) of said axle rod (14), the left side primary hinge piece (1) and the right side primary hinge piece (2) not only can make smooth rotation each other, but also can easily be lifted up for disassembling or assembling operation. The function of mutual rotation between the left and right side primary hinge pieces (1) (2) is done by means of the steel ball (232) on the tip of lug (231) of said axle (23) being fitted and rolling smoothly in the stair-case-shaped groove (131) on the top of said stair-case-shaped axle seat (13). Upon said left side primary hinge piece (1) being fixed, the right side primary hinge piece (2) can rotate upwards to either direction (clockwise or counter-clockwise) because of said steel ball (232) rolling up and down in said stair-case-shaped groove (131). For example, upon the left side primary hinge piece (1) being attached to the jamb (3) and the right side primary hinge piece (2) being attached to the door (4), said door (4) may be opened to either direction. When said door is in closed position, said steel ball (232) on the tip of said lug (231) of the axle (23) rests in the ball socket (132) at 0° position of said stair-case-shaped groove (131). When the door is opening, said steel ball (232) will roll upwards along said groove (131) to cause said door (4) move upwards. After the door being opened, said steel ball (232) is sitting on the slope portion of said groove (131), and the door may automatically be closed upon being released as a result of gravity effect. Since said steel ball (232) is liable to rest in the ball socket (132) at 0° position because of gravity effect, said door is closed and stopped in a position desired. FIG. 2 shows an assembled primary hinge in door closed position.

In case of necessity to have the door (4) being opened at a wide angle for a longer time, open the door (4) to an angle over 80° (it may be varied, if necessary) so as to have said steel ball (232) reaching to a horizontal portion on the groove (131) and to let the door stay in that position without returning to the zero (0°) position. In order to prevent the door from being closed by the normal flowing air, a ball socket (132) is furnished in the horizontal portion of said stair-case-shaped groove (131) so as to hold said steel ball therein for better positioning force of the door. As shown in FIG. 1, the stair-case-shaped axle seat (13) is furnished with a ball socket (132) at the position of 90° so as to have the door (4) being opened and positioned there till being closed mannally.

FIG. 1—1, and 1–2 show another embodiment of said staircase-shaped axle seat (13), which is used for a door (4) to open at a large angle and to automatically return to zero position.

Another features of said primary hinge are the structure of said staircase-shaped groove (131) on the stair-case-shaped axle seat (13), and the retarding pin (134), which is used for reducing the closing door speed to prevent from damaging the door (4), and the primary and the secondary hinges. As shown in FIG. 1 and FIG. 4, when the steel ball (232) rolls along said groove (131) and reaches the slope portion having less slant angle (35°–45°), a buffer effect will be generated to cause the door (4) moving slowly; further, a small hole (133) is furnished at a suitable point in the slope portion having less slant angle (35°–45°) so as to have the top end of said retarding pin (134) being slightly extended out therefrom; during the door being closed and upon said steel ball (232) rolling over said small hole (133), said retarding pin (134) will be pressed downwards to generate a buffer effect to the closing door.

FIG. 1–4 shows a V-shaped groove to replace said retarding pin (134) in the slope portion having less slant angle (35°–45°) of said groove (131). Said design is mainly used for a small and light door, which may be unable to close automatically because of having insufficient gravity to cause said steel ball (232) of the lug being fallen into the small hole (133).

B. The structure and function of the secondary hinge:

The general automatically closing door hinge may be deviated from its correct axis because of the assembling technique, the alignment technique, long time use, the weight of door itself, and the impact during opening and closing, etc.; any of said factors may cause the door to have difficulty returning its zero position smoothly therefore, the object of this secondary hinge structure is to eliminate the aforesaid drawbacks by using a dual eccentric axle bush means, thru which the axis of the primary and the secondary hinges can always be aligned on a co-axial line, and therefore the opening and closing rotation of the door is smooth.

Figure 7:
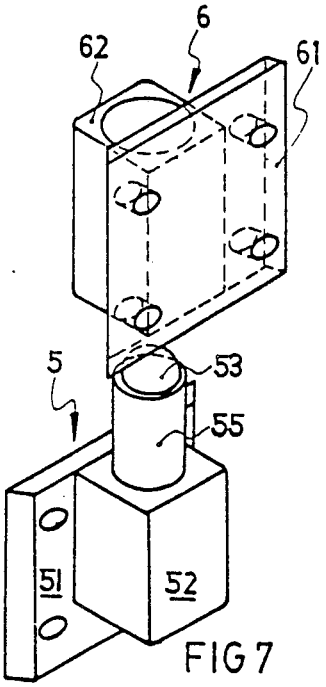
FIG. 7 shows a perspective and exploded view of the left and right side secondary hinge pieces in this invention.

FIG. 5 shows an exploded view of the secondary hinge, of which the shape looks similar to that of the primary hinge, and which comprises a left side secondary hinge piece (5) to be fixed at the lower portion of the jamb (3) and a right side secondary hinge piece (6) to be fixed at the lower portion of the door (4) as shown in FIG. 9. As shown in FIG. 5, said left side secondary hinge piece (5) is furnished with a base sleeve (52) that has a staircase-shaped hole (521) for installing and positioning the lower portion of the axle rod (53) therein. The upper portion of said axle rod (53) is furnished with a steel ball collar (531), which is to facilitate an inner eccentric axle bush (54) rotating smoothly around the upper portion of said axle rod (53) once said axle rod (53) being fitted into said bush (54); then, insert said inner eccentric axle bush (54) with the axle rod (53) into the outer eccentric axle bush (55); as soon as the lower end of said axle rod (53) reaches the staircase-shaped hole (521), put a locking ring (56) into the groove (532) so as to prevent said axle rod (53) from loosing. Between said base sleeve (52) and the inner and outer eccentric axle bushes (54, 55), a number of steel ball (522) are furnished on top of said base sleeve (52) so as to minimize the frictions among them. The lid (57) is to be fitted over the bottom of said staircase-shaped hole (521) for dust-proof and better looking purposes. FIG. 7 shows an outer view of a left side secondary hinge piece (5) being completely assembled.

FIG. 5 shows a right side secondary hinge piece (6) being attached with a base sleeve (62), and said hinge piece (6) is to be installed on the door (4). The staircase-shaped hole (621) in said base sleeve (62) is used for mounting and fixing an axle bush (63). Around the body of said axle bush (63), three small holes (631) being fitted with a steel ball (632) are furnished at an angle of 120° one after another, and a steel ball collar (633) is mounted over said steel balls (632) before the whole assembly being inserted into the staircase-shaped hole (621) of the base sleeve (62). Since both the axle bush (63) body and the staircase-shaped hole (621) have flat surface, said axle bush (63) once being inserted into said staircase-shaped hole (621) will not rotate therein; then, put the spring washer (64) and the nut (65) to the bottom of said hole (621) so as to have said axle bush (63) being fixed within said hole (621), on which a lid (66) is mounted for dustproof and better looking purposes. FIG. 7 shows an outer view of said right side secondary hinge piece (6) assembled.

Figure 8:
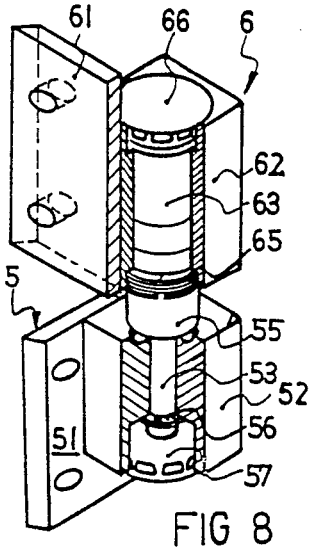
FIG. 8 shows a partial sectional view of said secondary hinge in closed state.
Figures 1, 8:
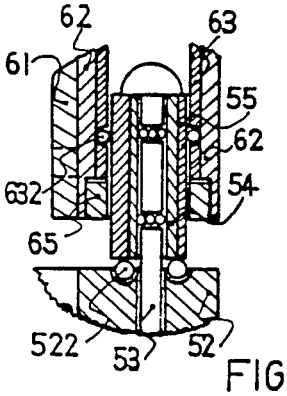
FIG. 1 shows an exploded view of the primary hinge in this invention.

As shown in FIGS. 5, 8, and 8-1, after said left and right side secondary hinge pieces (5, 6) being assembled together, put only the outer eccentric axle bush (55) into the axle hole (634) of the axle bush (63). Since the steel balls (632) of the axle bush (63) surround the outer edge of said outer eccentric (55), the left and right secondary hinge piece (5, 6) not only can rotate smoothly each other, but also can be assembled or disassembled easily.

Figure 6:
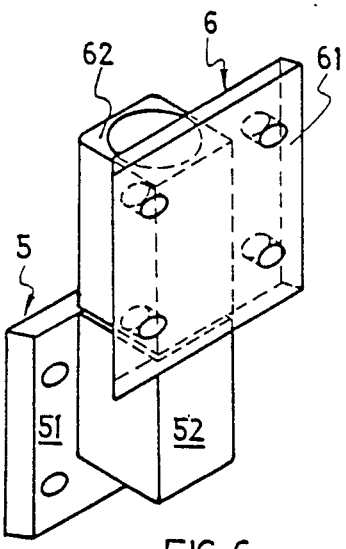
FIG. 6 shows an assembled view of said secondary hinge in closed state.

FIG. 6 shows an assembled secondary hinge in closed state.

FIG. 8 shows part of the sectional view of said secondary hinge in opening state.

As shown in FIG. 9, after said hinge assembly being installed to the jamb (3) and the door (4), the right side primary hinge piece (2) of said primary hinge will have an upward displacement upon opening the door (4); by the same token, the right side secondary hinge piece (6) attached to the lower portion of the door (4) will also move upwards to cause the space between the base sleeve (52) of said left side secondary hinge piece (5) and the base sleeve (62) of said right side secondary hinge piece (6) to be increased.

In the general conventional automatic hinges, the rotation of them on the door may not be so smooth as it should be after long time use or because of installation technique; however, the real point of said problem is that the axes of said primary hinge and the secondary hinge are not in alignment.

As shown in FIG. 5, the structure of said secondary hinge is so constructed that its axle rod (53) is put inside the inner eccentric axle bush (54) first, and then inside the outer eccentric axle bush (55) prior to inserting into the axle hole (634) of said axle bush (63); therefore, the axis of said secondary hinge may be varied in a way to align with the axis of said primary hinge on the same axis always.

FIGS. 5-1, 5-2, and 5-3 show the theory of self-corrective axis of said secondary hinge. As shown in FIG. 5-1, "a" stands for the distance (the eccentric distance) between the center of the outer circle and that of the inner circle within said inner eccentric axle bush (54); likewise, "a" also stands for the distance (the eccentric distance) between the center of the outer circle and that of the inner circle within said outer eccentric axle bush (55). The maximum distance between the center of the outer circle within said outer eccentric axle bush (55) and the center of the inner circle within said inner eccentric axle bush (54) is "2*a*", as shown in FIG. 5-1. FIG. 5-2 shows the minimum distance (zero distance) between the center of the outer circle within said outer eccentric axle bush (55) and the center of the inner circle within said inner eccentric axle bush (54), i.e. the said two centers being lapped on a same point. Since the axle bush (63) rotates around the outer eccentric axle bush (55), the axis of said rotating secondary hinge should be the center of the outer circle of said outer eccentric axle bush (55). As shown in FIG. 5-1, upon the inner and outer eccentric axle bushes (54, 55) rotating eccentrically, the distance between the new axis (the center of outer circle of the outer eccentric axle bush (55)) and the original axis (the center of inner circle of the inner eccentric axle bush (54)) of the axle rod (53) is "2*a*". As shown in FIG. 5-2, the new axis and the original axis of said axle rod (53) are in the same axis; then, if said new axis is located within a circle of 2*a* radius from the original axis, the axis of said secondary hinge may be varied within said circle having a radius of "2*a*" so as to be aligned on a co-axis with said primary hinge. FIG. 5-2 shows the eccentricity between the primary and the secondary hinges, but the axis of said secondary hinge is still maintained in the co-axis. FIG. 5-1 shows the eccentric state of said primary hinge; in that case, it is necessary to have the axis of secondary hinge adjusted to the position within "2*a*" distance from the original axis so as to maintain the primary hinge and the secondary hinge on a co-axis, i.e. said inner eccentric axle bush (54) and said outer eccentric axle bush (55) being adjusted to a new axis.

Since the new axis scope is still within the circle of "2*a*" radius, the distance between the axis of the outer circle of said inner eccentric axle bush (54) and the original axis is "a". When said inner eccentric axle bush

(54) rotating around said axle rod (53), the lows of the center of the outer circle of said inner eccentric axle bush (54) is still a circle, the solid line circle, as shown in FIG. 5-3. Likewise, during the center of the outer circle of said outer eccentric axle bush (55) rotating around the center of the outer circle of said inner eccentric axle bush (54), and during the locus of the center of outer circle of said inner eccentric axle bush (54) being a circle, a circle of "a" radius with its center along the locus of the aforesaid circle is formed, i.e. the indefinite number of dotted line circles with "a" radius. In fact, said indefinite number of circles of "a" radius are formed by the center locus of the center of outer circle of said outer eccentric axle bush (55).

Since the eccentric distance of both said outer eccentric axle bush (55) and said inner eccentric axle bush (54) is "a", the adjustable scope of the new axis of said outer eccentric axle bush (55) is right within a circle of "2*a*" radius from the original axis, including said original axis.

Upon said primary and secondary hinges installed to the jamb (3) and door (4) respectively, no matter how the axis of said primary hinge becomes what eccentric condition because of long time use or the operation of opening and closing the door (4), a new axis will always be formed by the adaptable adjustment between said inner eccentric axle bush (54) and said outer eccentric axle bush (55) so as to maintain a co-axis with said primary hinge, i.e. to keep a smooth operation in opening and closing the door.

C. The features of this invention:

(1). The staircase-shaped groove (131) of said staircase- haped axle seat (13) in said primary hinge may gradually be raising from the lowest 0° point to either clockwise or counter-clockwise direction because of the steel balls (232) under said axle (23) able to roll upwards to both directions; therefore, the door (4) can be opened to either direction, and can return to zero position automatically.

(2). At the positions of 0°, 90° (or other suitable position) along the groove (131) of said axle seat (13) of said primary hinge, a ball socket (132) is furnished; therefore, said steel ball (232) under the axle (23) may be positioned therein by falling into said socket (132), i.e., the door may be positioned at said 0° point after being closed, or may be opened for a long time at 90° (or larger angle) point after being opened without being closed by the normal flowing air.

(3). The groove (131) and the retarding pin (134) (or V-shaped groove (136) of the staircase-shaped axle seat (13) have a retarding effect to said steel ball (232) during said ball rolling downwards, i.e., during the door (4) being closed for buffer purpose.

(4). Either the left and right side primary hinge pieces (1,2) or the left and right side secondary hinge pieces (5, 6) are easy to be assembled or dis-assembed. During assembling, just put the left side primary and secondary hinge pieces (1, 5) on the jamb (3), and right sight primary and secondary hinge pieces (2, 6) on the door (4); in addition, it is easy to perform maintenance as well.

(5). In said secondary hinge, an inner and outer eccentric axle bushes (54, 55) are furnished so as to have the axis of said secondary hinge always automatically aligned in a co-axis with that of said primary hinge in order to maintain a smooth operation in opening or closing the door (4).

I claim:

1. A swinging door hinge assembly comprising a primary hinge and a secondary hinge, said primary hinge including a left side primary piece to be attached to an upper portion of a door jamb and a right side primary piece to be attached to an upper portion of a door; a base sleeve of the left side primary hinge piece fixedly supporting a staircase-shaped axle seat, an axle rod being installed in a center hole of said staircase-shaped axle seat; during the assembling of said left and right side primary hinge pieces, a top end of said axle rod being insertable into an axle hole of the right side primary hinge piece; a rolling member associated with a lug under said axle rod being disposed in the staircase-shaped groove on top of said staircase-shaped axle seat; wherein upon the door being opened clockwise or counter-clockwise, the lug drives said right side primary hinge piece to rotate over said left side primary hinge to cause said rolling member of said lug under the axle rod to roll upwards along said staircase-shaped groove; wherein said door is able to be closed slowly while said rolling member rolls downwards along said staircase-shaped groove; and said secondary hinge comprises a left side secondary hinge piece attachable to the lower portion of the door jamb and a right side secondary hinge piece attachable to the lower portion of the door; an axle rod being inserted into a base sleeve of said left side secondary hinge piece; an upper portion of said axle rod being positioned in an inner eccentric axle bushing to be inserted inside an outer eccentric axle bushing; wherein upon assembling the left and right secondary hinge pieces together, said outer eccentric axle bushing being positioned in an axle hole of said right side secondary hinge piece; wherein in opening or closing the door, said right side secondary hinge piece is rotated on said left side secondary hinge piece, and the axle bushing of said right side secondary hinge piece rotates around said outer eccentric axle bushing; by means of mutual rotation of said inner and outer eccentric axle bushings, a co-axis being formed automatically with said primary hinge, wherein the staircase-shaped groove on the top surface of the staircase-shaped axle seat of said primary hinge is gradually and slantingly raised in height from 0° position to either the clockwise or counter-clockwise direction; and upon reaching a point about 80°, there is a flat surface; and at the points approximately 0° and 90°, a depression on a less slanted slope is furnished, a spring and a retarding pin being installed in said depression.

2. An assembly as claimed in claim 1, wherein the eccentric distance of said inner eccentric axle bushing of said secondary hinge is equal to that of said outer eccentric axle bushing.

3. As assembly according to claim 1, wherein said rolling member is a steel ball.

4. An assembly according to claim 1, wherein said rolling member is a steel roller.

5. An assembly according to claim 1, wherein said depression is a ball socket.

6. An assembly according to claim 1, wherein said depression is a V-shaped groove.

* * * * *